United States Patent [19]

Brown

[11] 3,958,806

[45] May 25, 1976

[54] BARREL BALL GAME

[76] Inventor: Asa Elliott Brown, 7 Mt. View St., Hamburg, N.J. 07419

[22] Filed: Aug. 11, 1970

[21] Appl. No.: 62,841

[52] U.S. Cl. ..... 273/85 C; 273/1.5 R; 273/105.2

[51] Int. Cl.[2] ..... A63B 63/06; A63F 7/06; A63F 7/14

[58] Field of Search ..... 273/85 R, 85 C, 85 E, 273/1.5 R, 94 R, 94 C, 94 E, 105.2

[56] References Cited

UNITED STATES PATENTS

| | | | |
|---|---|---|---|
| 1,116,593 | 11/1914 | Johnson | 273/85 C UX |
| 1,821,918 | 9/1931 | Bishop | 273/85 E |
| 1,827,885 | 10/1931 | Emenhiser | 273/85 E |
| 2,735,682 | 2/1956 | Sweet | 273/1.5 R X |
| 2,893,734 | 7/1959 | Tarte, Jr. | 273/1.5 R X |
| 3,103,362 | 9/1963 | Elofson | 273/105.2 X |
| 3,477,714 | 11/1969 | Garlington | 273/1.5 R |
| 3,602,505 | 8/1971 | Friend | 273/1.5 R |

FOREIGN PATENTS OR APPLICATIONS

| | | | |
|---|---|---|---|
| 976,896 | 11/1950 | France | 273/105.2 |
| 498,090 | 1954 | Italy | 273/85 E |

*Primary Examiner*—Paul E. Shapiro
*Attorney, Agent, or Firm*—Bruce L. Adams

[57] ABSTRACT

A ball game comprises a transparent barrel-shaped housing having mounted therein a plurality of circumferentially spaced-apart baskets. A game ball is disposed within the housing and a series of manually-actuated paddle assemblies are arranged around the base of the housing operative to place the game ball in flight towards one of the baskets. The floor of the housing is inclined downwardly from the periphery of the housing and has a plurality of centrally located ball receiving openings. The inner ends of the paddle assemblies are positioned beneath the openings. A motor may be provided for rotating the baskets and a score keeping device including a sensor located beneath each basket may be provided for indicating each time a basket is made. A light is also provided for illuminating the interior of the barrel-shaped housing.

5 Claims, 5 Drawing Figures

BARREL BALL GAME

The present invention relates to an amusement game and more particularly, to a ball game which may be played by one or more persons.

Numerous toys and games are known which are intended to occupy the pasttimes and maintain the interests of the players. A disadvantage of most amusement games now available are that they are either too simple to hold the interest of adults or they are too complicated and time-consuming to hold the fascination of youngsters. Many attempts have been made to provide games which may be played by persons of all ages but these attempts have not met with much success in that they did not stimulate or hold the interest of players of different ages. Another drawback of many prior art games is that they are slow-moving with much waiting or delay time between each player's turn and hence they do not hold the excitement of the players.

A principal object of the present invention is to provide an amusement game which may be played and enjoyed by persons of all ages.

Another object of the present invention is to provide a ball game which is fast-moving and has very little delay time between each player's turn.

According to the invention the amusement game comprises a plurality of ball baskets connected in circumferentially spaced-apart relationship around the interior of a transparent barrel-shaped housing. A game ball is disposed within the transparent housing and a series of pivotally mounted paddles are arranged beneath the barrel-shaped housing by which the players shoot the game ball towards designated ones of the ball baskets.

Other objects, features and advantages of the amusement game in accordance with the present invention will be better understood as described in the following specification and appended claims when read in conjunction with the following drawings in which:

Figure 1:
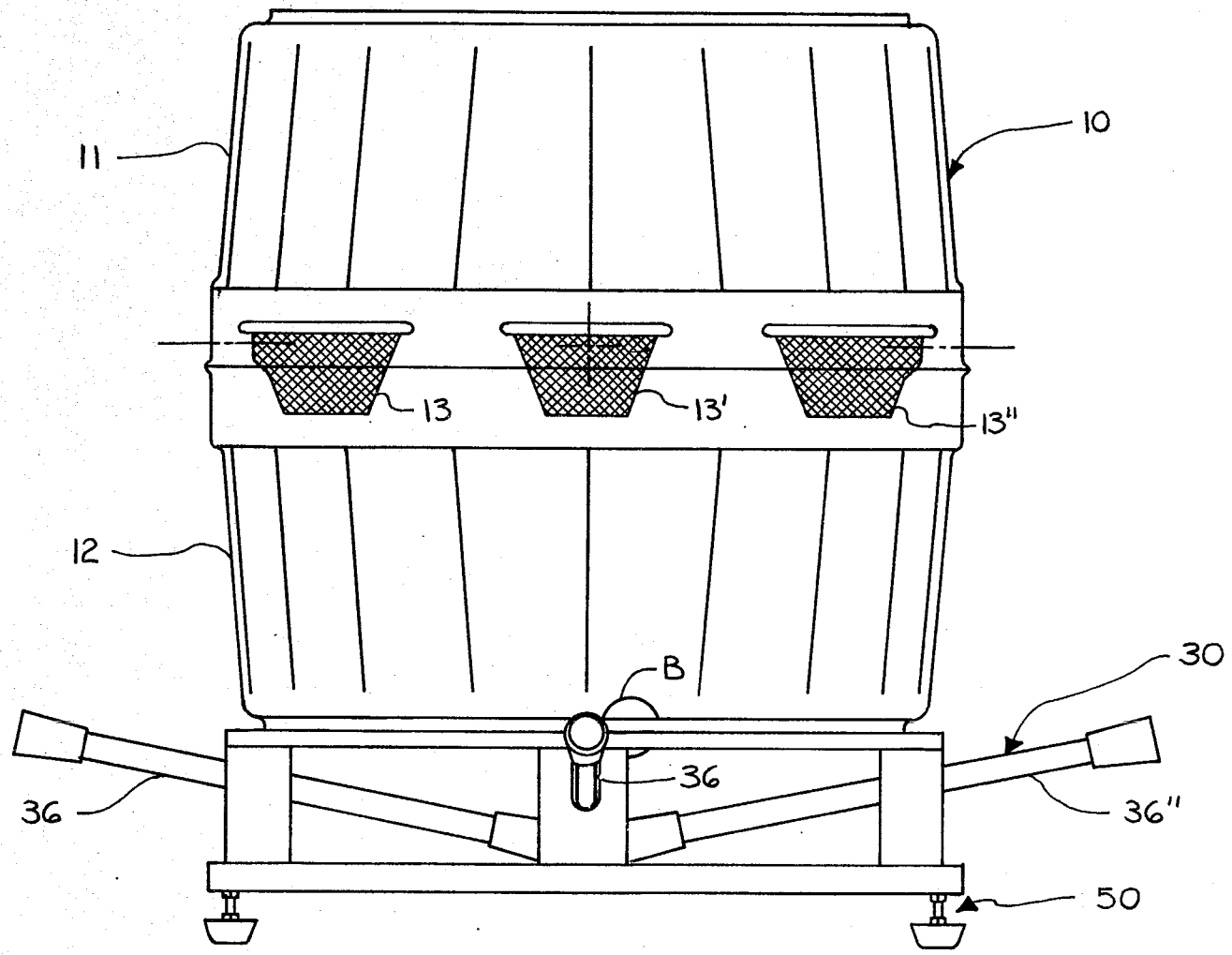
FIG. 1 is a perspective view of the barrel ball game according to the present invention.

As shown in FIG. 1, the barrel ball game is made up of three major components, a transparent barrel-shaped housing 10, a paddle mechanism 30 and an adjustable mounting platform 50. The barrel housing 10 is formed preferably of easily mouldable material and comprises a pair of transparent barrel sections 11, 12 which are connected together to define a transparent barrel-shaped housing. Any suitable connecting means may be used to connect the two barrel sections together and as shown in this embodiment, a friction fit is employed.

Figure 2:
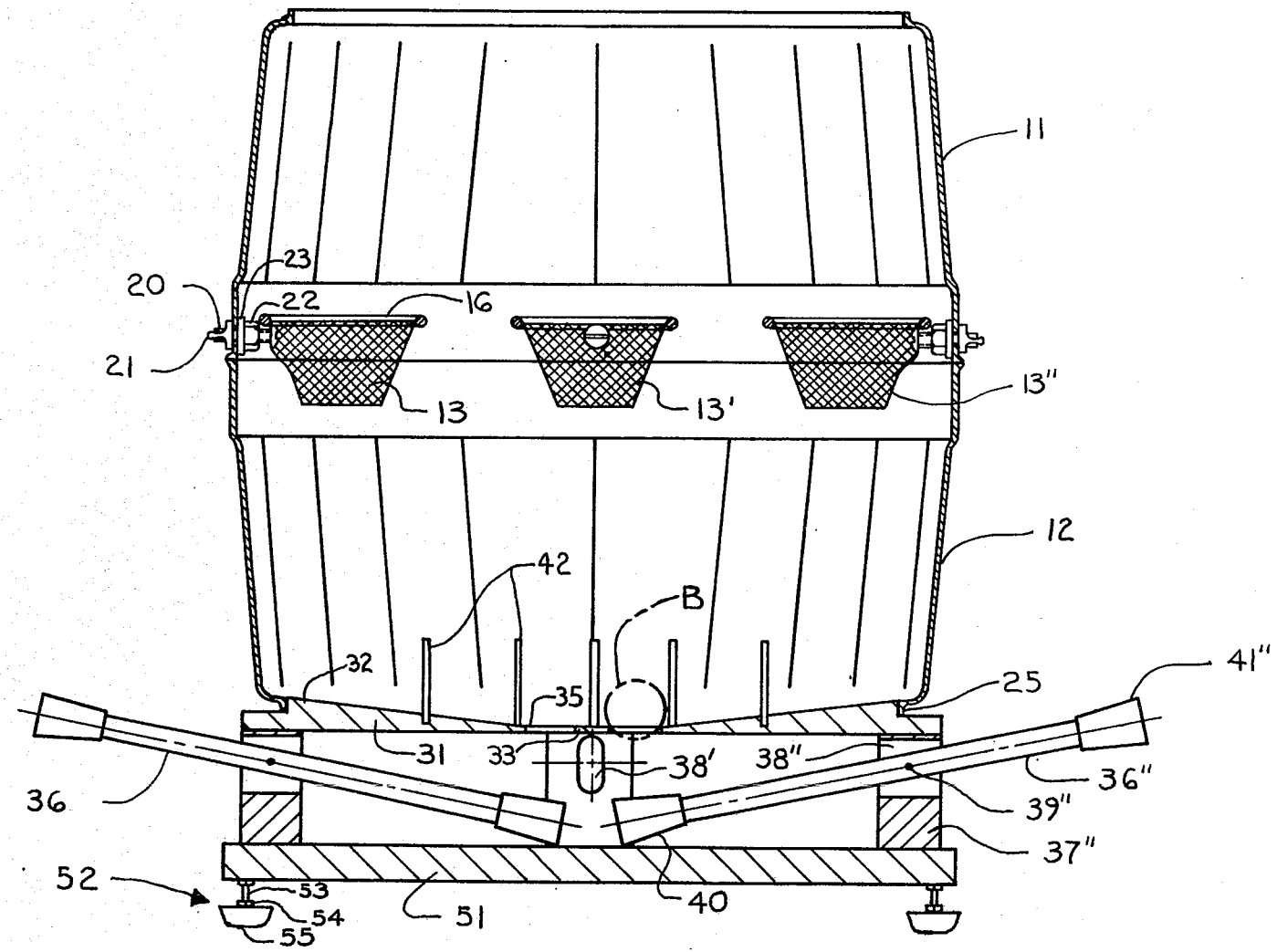
FIG. 2 is a sectional view of the barrel ball game shown in FIG. 1.

The upper barrel section 11 has a cylindrical configuration defining an arcuate, interior portion of the housing and has fastened thereto a plurality of ball-receiving means in the form of differently colored nets or baskets 13. As shown in FIG. 2, each net or basket is spaced-apart around a peripheral interior portion of the upper barrel section 11 and depends from a suitable rim 16 which is removably fastened to the interior of the upper barrel section 11. The fastening means comprises a threaded screw 20 passing through the drum housing cooperating with a wing nut 21 to mount the baskets in position. A lock nut 22 and washer 23 may be positioned on the screw 20 interiorly of the housing to securely hold the baskets in place.

The lower barrel section 12 is also cylindrically shaped and formed of a suitable plastic or other easily moulded material. Around the bottom portion of the lower barrel section 12 is provided a circular rim 25 which complements and removably fits around a circular raised shoulder or flange portion 32 of the paddle mechanism 30. The interconnection between the rim 25 of the lower barrel section 12 and the paddle mechanism 30 is preferably a friction fit and obviously any type of connecting means may be employed without departing from the spirit of the present invention.

As most clearly shown in FIG. 2, the paddle mechanism 30 constitutes the floor portion of the interior of the barrel housing 10. The paddle mechanism comprises a radially tapered floor portion 31 terminating in the above-described raised shoulder 32. The tapered floor portion 31 is inclined radially downwardly from its peripheral portion to its central portion 33 A plurality of apertures 35 are provided in the tapered section 31 corresponding in number to the number of baskets and each aperture is dimensioned to partially receive therein a portion of the game ball B. The centermost portion of the floor portion 31 may also be provided with a semispherical bumper portion (not shown) to ensure that the game ball B will be directed into one of the apertures 35 rather than coming to rest at this centermost area.

The paddle mechanism 30 comprises the ball shooting means and includes a plurality of paddle assemblies comprising pivotally mounted paddles 36 equal in number to the number of the apertures 35. Each paddle comprises a lightweight rod which is eccentrically pivoted with respect to its longitudinal length so that the weight of the paddle is unequally distributed relative to the pivot point. Due to such a pivotal mounting, the paddles 36 normally assume an inclined position, as shown in FIGS. 1 and 2. Each paddle is mounted in a mounting block 37 having an elongated aperture 38 extending therethrough. A hole is provided in each of the rods and an undersized pivot pin 39 loosely extends through each hole and is attached at both ends to its respective mounting block 37. By such an arrangement, the paddles 36 are mounted for pivotal movement about the pins 39.

Each of the paddles 36 has a ball-striking end and a hand-striking end. When the hand-striking end of the paddle 36 is manually flicked or depressed, the paddle will pivot upwardly (as viewed in FIGS. 1 and 2) causing the ball-striking end to partially extend through its corresponding aperture 35 to thereby strike the game ball B. On the ball-striking end of each paddle is provided a flared rubber tip 40 which functions to direct the game ball B in a flight direction towards its associated basket when same strikes the ball. A similar rubber tip 41 is provided on the hand-striking end of each paddle to cushion the impact of the player's hand. Thus it can been seen that in response to manual depression of the hand-striking rubber tip 41, the paddle 36 is pivoted towards its associated basket 13 and such movement coacts with the appropriately tapered rubber tip portion 40 to send the game ball B in a direction of flight towards its associated basket. A plurality of bumper pegs 42 project upwardly from the floor portion 31 and function to randomly deflect the game ball B as it rolls downwardly towards one of the apertures 35.

The mounting platform 50 comprises a level base portion 51 and a plurality of adjustable leg portions 52. Each adjustable leg portion 52 comprises a threaded shaft 53 cooperative with a nut 54 which is permanently affixed to a rubber foot 55. In response to manual rotation of the rubber foot 55, the height of the foot 55 can be selectively varied by the nut 54 being either threaded onto or being backed off of the threaded shaft 53. Of course the present invention can also be practiced without the mounting platform 50 whereupon the paddle mechanism 30 is placed on a level surface.

The operation of the barrel ball game will now be described. A lightweight ball, for example a Ping Pong ball B, is placed within the transparent barrel-shaped housing 10. The ball rolls down the inclined floor portion 31 and eventually lodges within one of the apertures 35. This condition is depicted in FIGS. 1 and 2. The players position themselves around the barrel ball game and each player is assigned and operates one of the paddle assemblies.

As depicted in FIG. 2, the game ball B is positioned within the aperture 35 which overlies the paddle 36'' and hence the player assigned to this paddle is in position to take a shot at sinking the ball in his basket 13''. A shot is taken by manually depressing or flicking the hand-striking end of the paddle 36 causing the paddle to pivot upwardly whereupon the ball-striking rubber tip 40 is brought into contact with the game ball B. Due to the inclination of the rubber tip 40 cooperating with the direction of movement of the paddle itself, the game ball B is deflected radially outwardly and upwardly in a direction towards the basket 13''. It will be appreciated that every shot will not result in a basket and the making of a basket depends upon the force exerted by the player on the paddle and the rebounding and caroming of the ball off the interior of the cylindrical housing.

After each shot, the game ball B falls to the bottom of the barrel 10 and rolls downwardly along the inclined floor portion 31 until it settles into one of the apertures 35 whereupon it is in position for the next shot. The bumper pegs 42 are positioned to cause the game ball B to randomly deflect in an unpredictable manner thereby leaving the particular aperture 35 in which the ball finally comes to reset as a matter of chance.

Any desired scoring arrangement may be used without departing from the scope of the present invention. For example, two points may be awarded to a player each time he shoots the ball through his basket whereas one point may be subtracted each time he shoots the ball through another player's basket. Alternatively, two or more game balls may simultaneously be used. Another approach is to keep track of the number of baskets made by each player playing alone for an agreed upon time period, for example, 5 minutes. Obviously any other scoring system may be used without departing from the spirit of the present invention.

Figure 3:
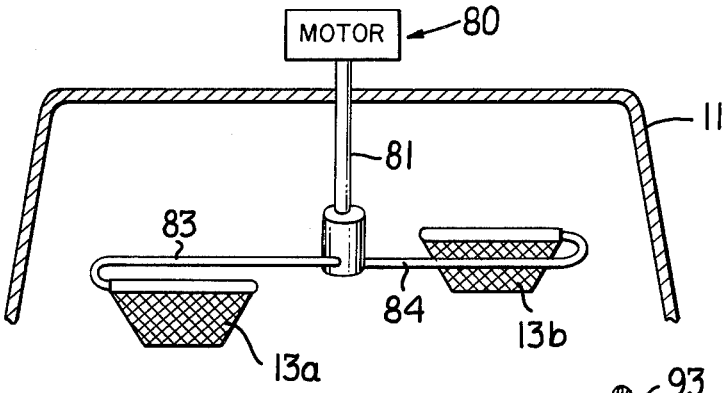
FIG. 3 is a plan view showing an embodiment of the present invention employing rotating baskets.

Another embodiment of the present invention is disclosed in FIG. 3. In this embodiment, the nets or baskets 13 are rotationally driven and the players shoot at moving baskets. One manner of obtaining this is by providing a rotary motor 80 which may be a conventional battery powered motor or a spring motor or the like. During operation, the motor rotationally drives a shaft 81 to which is connected a pair of mounting arms 83 and 84. The baskets **13*a* and 13*b* are connected in angularly spaced-apart relationship to respective ones of the mounting arms whereby operation of the motor 80 effects rotation of the baskets 13*a* and 13*b* together as an integral unit around an inner peripheral portion of the housing. Any number of mounting arms may be provided and two such arms are shown in FIG. 3**.

Figure 4:
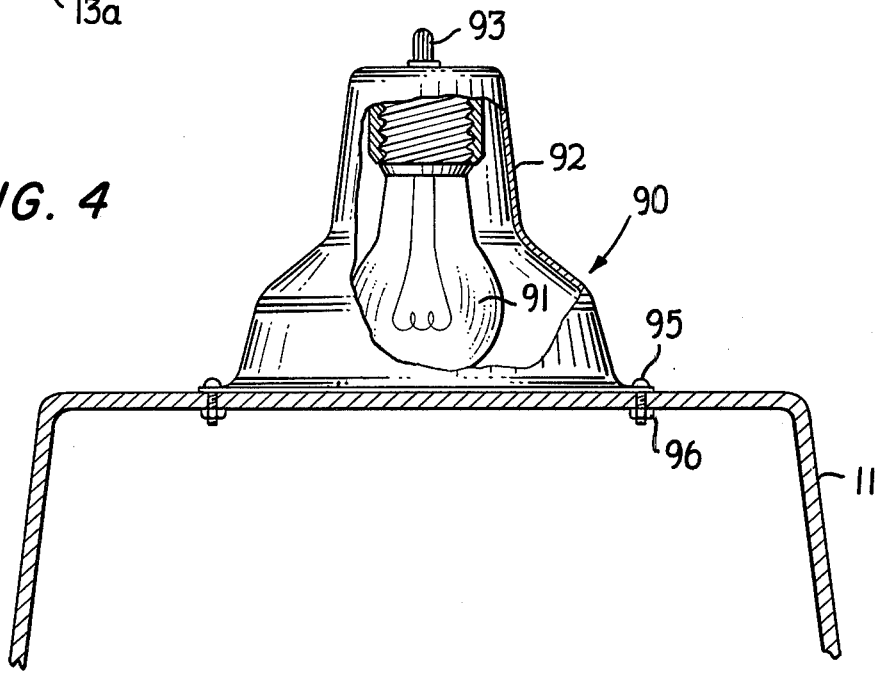
FIG. 4 is a perspective view depicting another embodiment of the present invention having illuminating means.

The barrel ball game may also be provided with illuminating means for illuminating the interior of the barrel-shaped housing and such an arrangement is shown in FIG. 4. A light assembly 90 is connected to the upper barrel section 11 whereupon light rays may be directed interiorly of the barrel housing. The illuminating means comprises a light bulb 91 mounted in a light shield or guide 92 which is configured to direct the light rays into the transparent barrel sections. An on-off switch 93 is provided to manually control the actuation of the light. The light guide 92 is mounted by means of screws 95 cooperating with nuts 96 onto the upper barrel section 11.

Figure 5:
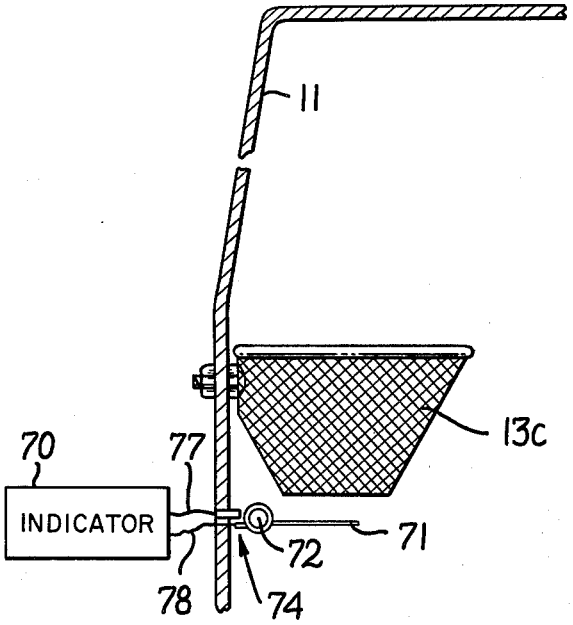
FIG. 5 is a diagrammatic view of one type of indicator usable with the barrel ball game of the present invention.

Another variation of the present invention is shown in FIG. 5. In this embodiment, an indicating means is employed to automatically provide a sensory indication to the players whenever a basket is made. An indicator 70 is disclosed which may comprise a light, horn, buzzer or any other type of indicator. As shown in FIG. 5, the indicator 70 is electrically actuated by effecting an opening and closing of an electric circuit containing therein the indicator 70 in response to passage of the game ball B through the net **13*c*. A feeler or detector arm 71 is pivotally mounted on a shaft 72 which is affixed to the upper barrel section 11. The indicator 70 comprises an indicating device and a source of energy for driving the indicating device electrically connected in a normally open electric circuit which includes conductors 77 and 78. The conductors 77 and 78 terminate interiorly of the housing in a pair of electrical contacts one of which is stationary and affixed to the section 11 and the other of which is movable and connected to the detector arm 71 to be moved into contact with the stationary contact in response to pivotal movement of the detector arm 71. As shown in FIG. 5**, the electric circuit is in its normally open position.

When a game ball B is inserted or dropped through the basket **13*c*, the ball effects pivotal movement of the detector arm 71 causing the movable contact to engage with the stationary contact thereby closing the circuit and actuating the indicator. A light spring or other means (not shown) is used to bias the switch into the normally open position shown in FIG. 5** and such switching mechanisms per se are well known in the game art.

Other modifications and variations of the ball game in accordance with the present invention may be made without departing from the spirit and scope of the present invention which is limited only by the appended claims.

What I claim and desire to secure by Letters Patent is:

1. An amusement ball game comprising: means defining a transparent housing having an arcuate interior portion and a tapered floor portion inclined downwardly from the periphery of said arcuate interior portion to a common central portion; a plurality of ball-receiving means disposed in circumferentially spaced-apart relationship within an upper portion of said housing for receiving therethrough a game ball; means mounting each of said ball-receiving means for rotational movement around the inner periphery of said arcuate interior portion of said housing; means for effecting rotational movement of said plurality of ball-receiving means; a game ball disposed within said housing; means defining a plurality of apertures in said tapered floor portion each dimensioned to receive therethrough a portion only of said game ball to thereby releasably hold same in position to be shot towards said ball-receiving means; and a plurality of manually-actuated paddle assemblies each positioned adjacent one of said apertures and cooperative therewith when said game ball is disposed therein to shoot said game ball towards one of said ball-receiving means, each said paddle assembly comprising an elongated rod having a ball-striking end and a hand-striking end, and mounting means mounting said elongated rod for manual pivotal movement in response to manual depression of said hand-striking end from a first position wherein said ball-striking end is spaced-apart from its associated aperture to a second position wherein said ball-striking end partially extends through its associated aperture.

2. A ball game according to claim 1; wherein each said ball-striking end comprises a tapered tip portion having an inclination cooperative with the direction of pivotal movement of said rod to direct said game ball towards one of said ball-receiving means in response to manual depression of said hand-striking end.

3. A ball game according to claim 1; including a plurality of projections projecting upwardly from said tapered floor portion to deflect said game ball in a random manner while same rolls down said tapered floor portion towards said apertures.

4. A ball game according to claim 1; wherein said transparent housing has a barrel-shaped configuration defining said arcuate interior portion; and wherein said plurality of ball-receiving means comprises a plurality of circumferentially spaced-apart baskets mounted for rotational movement around said barrel-shaped housing.

5. A ball game according to claim 1; wherein said means mounting each of said ball-receiving means for rotational movement includes means connecting together said plurality of ball-receiving means in angularly spaced-apart relationship for rotational movement together as an integral unit.

* * * * *